United States Patent [19]

Robinson

[11] 3,942,292

[45] Mar. 9, 1976

[54] LINTEL FOR DOUBLE-SKIN WALL

[75] Inventor: Brian Robinson, Rogerstone, Wales

[73] Assignee: Catnic Components Limited, Caerphilly, Wales

[22] Filed: Dec. 26, 1973

[21] Appl. No.: 428,000

Related U.S. Application Data

[63] Continuation-in-part of Ser. No. 250,951, May 8, 1972, abandoned.

[52] U.S. Cl. ..... 52/204; 52/61; 52/573

[51] Int. Cl.[2] ..... E06B 1/04

[58] Field of Search ..... 52/213, 216, 412, 204, 52/573, 566, 58–62

[56] References Cited

UNITED STATES PATENTS

| | | | |
|---|---|---|---|
| 756,684 | 4/1904 | Munro | 52/62 |
| 3,581,450 | 6/1971 | Patry | 52/58 |
| R17,818 | 9/1930 | Young | 52/61 |

FOREIGN PATENTS OR APPLICATIONS

| | | | |
|---|---|---|---|
| 1,965,465 | 12/1969 | Germany | 52/204 |

*Primary Examiner*—Frank L. Abbott
*Assistant Examiner*—Carl D. Friedman
*Attorney, Agent, or Firm*—Woodhams, Blanchard and Flynn

[57] ABSTRACT

A lintel for a double-skin wall including a first member secured to the inner skin and a second member secured to the outer skin and adapted to be disposed over an aperture or opening formed in said wall. The first member has a downwardly extending flange portion disposed within the cavity between the inner and outer skins and spaced a slight distance from the adjacent surface of the inner skin. The second member is secured to the outer skin, as by having a substantially horizontal flange disposed below a course of blocks or the like. The second member has a sloped plate secured to the inner edge of the horizontal flange and extending upwardly into and across the cavity. The sloped plate has an upwardly extending flange on the upper free edge thereof which extends into a recess defined between the inner skin and the downwardly projecting flange associated with the first member.

3 Claims, 1 Drawing Figure

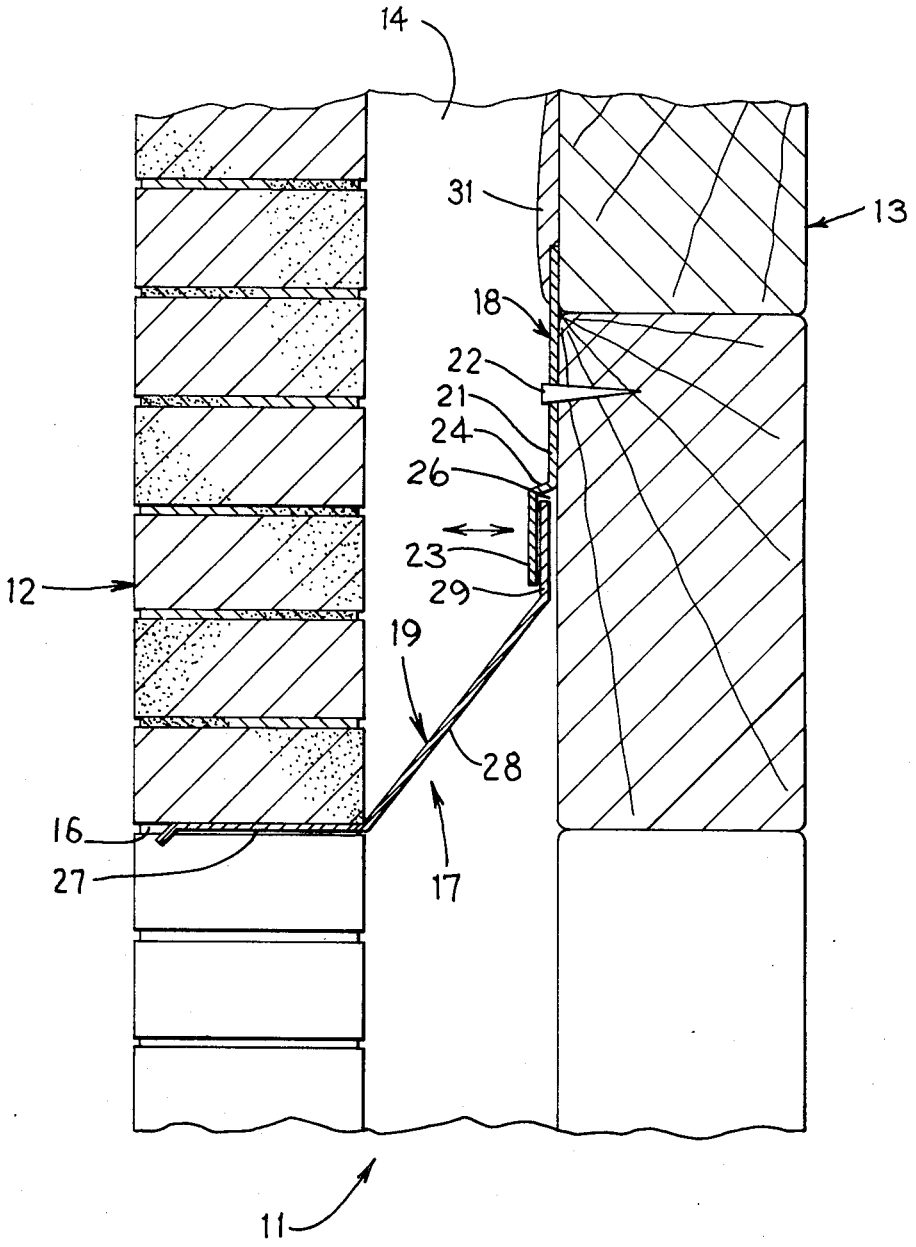
14
31
13
18
22
21
24
26
23
29
12
19
28
16
27
17
11

LINTEL FOR DOUBLE-SKIN WALL

CROSS-REFERENCE TO RELATED APPLICATION

This application is a continuation-in-part of my copending application Ser. No. 250,951, filed May 8, 1972, now abandoned.

FIELD OF THE INVENTION

This invention relates to a lintel for a wall and, in particular, to an improved lintel for use with a double-skin wall for permitting relative displacement or movement between the skins.

BACKGROUND OF THE INVENTION

Lintels or beams comprising heavy baulks of timber have been used for many years when it is desired to make an aperture or opening in a wall. Such lintels or beams are disposed along the upper edge of the opening and are used to support courses of bricks or other building materials. Lintels and beams made of heavy gauge metal have been utilized, which lintels are necessarily heavy to provide the rigidity and strength required to support the brick work which extends over the opening.

In an attempt to improve the known wall structures, several lightweight lintels have been developed for use in wall constructions, and several of these improved lintel structures are disclosed in German Patent application No. 1 965 465, published Dec. 30, 1969. While lintels of the type disclosed in the above-mentioned application have proven highly successful and desirable in many use situations, nevertheless these known lintels have all been fixedly connected to both the inner and outer skins of the wall, thereby rigidly connecting same together. This was generally believed necessary in order to provide the wall with the required strength and rigidity, particularly in the vicinity of the wall opening.

However, it has been discovered that in some instances it is desirable to permit the inner and outer skins to be relatively displaced or moved with respect to one another. Such movement has been prevented or effectively restricted when utilizing the known lintels, which lintels are effectively of a unitary structure.

Accordingly, it is an object of the present invention to provide an improved lintel particularly suitable for use in a double-skin wall to permit relative displacement or movement between the inner and outer skins of the wall.

A further object of the present invention is to provide an improved lintel, as aforesaid, which is essentially of two-piece construction whereby one lintel member is fixed to the outer skin and the other lintel member is fixed to the inner skin, which lintel members coact to create an effective watertight seal between the inner and outer skins while at the same time enabling the skins to be relatively displaced toward or away from one another through a limited extent.

Still a further object of the present invention is to provide an improved lintel, as aforesaid, which facilitates the construction of the wall due to the lintel being of a multi-piece construction, so that the individual pieces can be readily installed during the construction of the inner and outer skins of the wall.

Other objects and purposes of the present invention will be apparent to persons acquainted with devices of this type upon reading the following specification and inspecting the accompanying drawing.

BRIEF DESCRIPTION OF THE DRAWING

The single attached drawing illustrates therein a cross-sectional view of an improved lintel according to the present invention as incorporated into a double-skin wall.

SUMMARY OF THE INVENTION

The objects and purposes of the present invention are met by providing a lintel which is of a two-piece construction and is adapted to span the cavity between the inner and outer skins of a double-skin wall. The lintel includes a first member which is fixed to the inner skin and has a platelike portion which defines a downwardly extending flange positioned within the cavity and spaced a selected distance from the adjacent surface of the inner skin. The lintel includes a second member which has a substantially horizontal plate adapted to be disposed below a row of building bricks, which plate is fixedly connected at the inner edge thereof to a damp resistor plate which is disposed within the cavity and extends rearwardly and upwardly toward the inner skin. The upper edge of the damp resistor plate has a substantially vertically extending flange thereon which projects into the slotlike recess which is formed between the inner skin and the downwardly projecting flange formed on the first member for permitting relative displacement or movement between the inner and outer skins of the wall.

DETAILED DESCRIPTION

The drawing illustrates therein a double-skinned wall 11 which includes an outer skin 12 and an inner skin 13 separated by an internal cavity or space 14. The outer skin 12 is, in the illustrated embodiment, constructed from several courses of blocks or bricks which are mortared together in a conventional manner. The inner skin 13 is, in the illustrated embodiment, constructed from elongated wooden beams or timbers.

The wall 11 is provided with an aperture or opening 16 formed therethrough. Thus, a lintel 17 constructed according to the present invention is disposed directly above the opening 16 for interconnecting the inner and outer skins 12 and 13, respectively, in a sealed relationship. The lintel 17, which is preferably constructed from platelike metal, has a length slightly greater than the length of the opening 16 so that the lintel, when placed across the opening, will overlie the walls by at least 6 inches on either side of the opening. The ends of the lintel will thus be securely connected to the surrounding walls, such as by being embedded in cement or mortar associated with the outer skin 12. The lintel 17 comprises a two-piece structure which includes an elongated upper lintel member 18 fixedly secured to the inner skin 13 and coacting with an elongated lower lintel member 19 fixedly connected relative to the outer skin 12.

Considering first the upper lintel member 18, same is substantially Z-shaped and includes an upper plate 21 disposed substantially flush with the surface of the inner skin 13 and fixedly secured thereto, as by means of pins or screws 22. The upper lintel member 18 has a further plate 23 which is substantially parallel to and laterally offset from the plate 22, being fixedly connected thereto by means of the intermediate connecting portion 24. The lower plate 23, which forms a downwardly projecting flange, is spaced outwardly a selected distance from the adjacent surface of the inner skin 13 so as to define an elongated slotlike recess 26 therebetween.

The lower lintel member 19 includes a substantially horizontal plate 27 which is disposed in alignment with the outer skin 12 and effectively defines the upper edge of the opening 16. The plate 27 is adapted to support on the upper surface thereof further courses of building bricks or the like. The inner edge of the elongated plate 27 is fixedly, here integrally, connected to the lower edge of a rearwardly and upwardly inclined plate 28 which is disposed within and substantially spans the cavity 14. The plate 28, which functions as a damp resistor plate, has a platelike flange 29 fixedly, here integrally, connected to the upper edge thereof. The flange 29 extends longitudinally throughout the complete length of the lower lintel member 19 and extends vertically upwardly so as to be substantially parallel with the downwardly projecting flange 23. When the upper and lower lintel members 18 and 19 are properly assembled with respect to the inner and outer skins of the wall, the platelike flange 29 extends upwardly a substantial distance into the recess 26 as illustrated in the drawing. Further, as illustrated, the recess 26 has a width as measured between the plate 23 and the adjacent surface of the skin 13 which is substantially greater than the thickness of the flange 29.

The upper edge of the upper lintel member 18 is preferably sealed relative to the inner skin 13 by means of a sealing member 31 extending longitudinally therealong, which sealing member 31 is fixedly secured to the inner skin 13. The sealing member 31 may be of any conventional construction, such as bituminous paper or other water-proofing material, the member 31 being positioned to overlap the upper edge of the plate 21.

After the lintel 17 of the present invention has been positioned within a wall 11, any moisture condensing in the cavity 14 runs down the surface of the inner skin and over the water-proof layer 31 onto the upper lintel member 18. Due to the offset portion 24, the upper lintel member causes the moisture to flow outwardly so as to be deposited onto the upper surface of the damp resistor plate 28, whereupon the water then flows downwardly and outwardly through the outer skin 12. Due to the structure of the lintel 17, moisture is thus prevented from gaining access into the interior of the room defined by the wall 11, since the lintel effectively prevents the moisture from coming into contact with whatever structure, such as a window, which is located within the opening 16. The inner wall of the room may thus be finished as desired, such as plastered, and any auxiliary fittings such as curtain rods or the like may then be easily secured in position by drilling through the plaster so as to anchor same into the wood forming the inner skin 13.

A further and significant advantage of the present construction results from the clearance which is provided between the plates 23 and 29. Since the recess 26 has a width which is greater than the thickness of the plate 29, the inner and outer skins 12 and 13 can thus be relatively moved or displaced with respect to one another, such as in the directions indicated by the doubleheaded arrow illustrated in the drawing. The recess 26 thus enables relative displacement between the walls while at the same time retaining the moisture sealed characteristic which is essential.

While the invention as described above has been disclosed in conjunction for use over an aperture or opening in a wall, it will be understood that the lintel of the present invention may also be utilized as beams or joists in other areas and locations of a building, and need not necessarily be restricted for use over a wall opening.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a load-carrying lintel for use in a vertical wall having spaced and substantially parallel inner and outer vertical skins defining a cavity therebetween, said lintel comprising:

a first lintel member adapted to be fixedly connected to said inner skin;

a second lintel member adapted to be fixedly connected to said outer skin at an elevation below said first lintel member;

said second lintel member including a plate portion disposed within and substantially spanning said cavity and being inclined upwardly and inwardly from said outer skin toward said inner skin; and means coacting between said plate portion and said first lintel member (1) for preventing moisture from passing therebetween into the space below said plate portion and (2) for permitting relative movement between said inner and outer skins in a horizontal direction toward or away from one another;

said coacting means includes a first platelike flange fixedly connected to said first lintel member and projecting downwardly therefrom, said first platelike flange being spaced a substantial distance from the adjacent surface of said inner skin to define a downwardly opening slotlike recess therebetween, said coacting means further including a second platelike flange fixedly secured to said plate portion adjacent the upper edge thereof, said second platelike flange projecting upwardly from said plate portion and extending a substantial distance into said slotlike recess so that said first and second platelike flanges substantially overlap, said second platelike flange having a thickness substantially less than the width of said recess as defined between said first platelike flange and the adjacent wall of said inner skin;

said first lintel member having a substantially Z-shaped cross section and including first and second platelike portions disposed in substantially parallel and laterally spaced relationship and interconnected by an intermediate connecting portion, said first platelike portion being fixedly secured to the surface of said inner skin, said second platelike portion being spaced downwardly from said first platelike portion and spaced outwardly from the adjacent surface of said inner skin, said second platelike portion constituting said first platelike flange;

said second lintel member including a substantially horizontal load-carrying plate fixedly connected to said inclined plate portion adjacent the lower edge thereof, said horizontal plate being adapted to be embedded within said outer skin, and said second platelike flange being fixedly connected to the upper edge of said inclined plate portion and extending substantially vertically upwardly therefrom so as to project into said downwardly opening slotlike recess.

2. In a two-piece load-carrying lintel for use in a vertical wall having spaced and substantially parallel inner and outer vertical skins defining a cavity therebetween, said lintel consisting of:

a first substantially Z-shaped lintel member constructed from a thin platelike material and adapted to be fixedly connected to said inner skin;

a second lintel member constructed from a thin platelike material and adapted to be fixedly connected to said outer skin at an elevation below said first lintel member;

said second lintel member including a plate portion disposed within and substantially spanning said cavity and being inclined upwardly and inwardly from said outer skin toward said inner skin;

means coacting between said plate portion and said first lintel member (1) for preventing moisture from passing therebetween into the space below said plate portion and (2) for permitting relative movement between said inner and outer skins in a horizontal direction toward or away from one another;

said coacting means including a first platelike flange fixedly connected to said first lintel member and projecting downwardly therefrom and being spaced a substantial distance from the adjacent surface of said inner skin so as to define a downwardly opening slotlike recess therebetween, said coacting means further including a second platelike flange fixedly secured to said plate portion adjacent the upper edge thereof and projecting upwardly from said plate portion at a substantial angle thereto, said second platelike flange projecting upwardly from said plate portion and extending a substantial distance into said slotlike recess so that said first and second platelike flanges substantially overlap, said second platelike flange having a thickness substantially less than the width of said recess; and said first lintel member having a platelike mounting portion projecting upwardly from and fixedly connected to the upper edge of said first platelike flange by a short transversely extending connecting portion, said platelike mounting portion being substantially parallel to and laterally offset with respect to said first platelike flange, said platelike mounting portion being adapted to be fixedly connected to said inner skin.

3. A lintel according to claim 2, wherein said first and second lintel members are each constructed from sheetlike metal.

* * * * *